US011066892B2

(12) United States Patent
Gallagher et al.

(10) Patent No.: US 11,066,892 B2
(45) Date of Patent: Jul. 20, 2021

(54) BLOWOUT PREVENTER

(71) Applicant: Kinetic Pressure Control, Ltd., Houston, TX (US)

(72) Inventors: Bobby James Gallagher, Houston, TX (US); Steven Anthony Angstmann, Houston, TX (US); Billy Jack Gallagher, Greenslopes (AU)

(73) Assignee: Kinetic Pressure Control Ltd., Houston, TX (US)

( * ) Notice: Subject to any disclaimer, the term of this patent is extended or adjusted under 35 U.S.C. 154(b) by 0 days.

(21) Appl. No.: 16/298,870

(22) Filed: Mar. 11, 2019

(65) Prior Publication Data

US 2019/0203555 A1 Jul. 4, 2019

Related U.S. Application Data

(63) Continuation of application No. PCT/US2017/047875, filed on Aug. 22, 2017.

(60) Provisional application No. 62/393,511, filed on Sep. 12, 2016.

(51) Int. Cl.
*E21B 33/06* (2006.01)

(52) U.S. Cl.
CPC ..... *E21B 33/063* (2013.01); *E21B 33/06* (2013.01); *E21B 33/062* (2013.01)

(58) Field of Classification Search
CPC ..... E21B 33/06; E21B 33/062; E21B 33/063; E21B 33/08
USPC ..... 251/1.1, 1.2, 1.3
See application file for complete search history.

(56) References Cited

U.S. PATENT DOCUMENTS

| | | | | |
|---|---|---|---|---|
| 3,716,068 | A * | 2/1973 | Addison | E21B 29/08 137/67 |
| 3,766,979 | A | 10/1973 | Petrick | |
| 5,217,073 | A | 6/1993 | Bruns | |
| 8,316,872 | B1 * | 11/2012 | Milanovich | E21B 33/061 137/68.13 |
| 8,567,427 | B1 * | 10/2013 | Milanovich | E21B 43/116 137/68.13 |
| 8,794,308 | B1 * | 8/2014 | Milanovich | E21B 33/062 166/85.4 |
| 10,465,466 | B2 * | 11/2019 | Angstmann | E21B 33/063 |
| 2007/0246215 | A1 | 10/2007 | Springett et al. | |
| 2012/0043068 | A1 * | 2/2012 | Jahnke | E21B 33/063 166/55.1 |

(Continued)

OTHER PUBLICATIONS

Canadian Office Action dated Feb. 10, 2020 for, Canadian Patent Application No. 3,036,510.

(Continued)

*Primary Examiner* — Umashankar Venkatesan
(74) *Attorney, Agent, or Firm* — Victor H. Segura

(57) ABSTRACT

A blowout preventer includes a main housing containing a through bore. A first chamber is arranged transverse to the through bore. A second chamber is transverse to the through bore and is diametrically opposed to the first chamber. A first shearing device is located in the first chamber and a second shearing device located in the second chamber. The blowout preventer includes a charge that when activated propels each shearing device along its respective chamber and across the through bore into the opposing chamber, such that the first and second shearing devices are adjacent each other.

33 Claims, 4 Drawing Sheets

(56) References Cited

U.S. PATENT DOCUMENTS

| | | | |
|---|---|---|---|
| 2012/0073816 | A1 | 3/2012 | Springett et al. |
| 2012/0152561 | A1 | 6/2012 | Herbel et al. |

OTHER PUBLICATIONS

Search Report and Written Opinion, International Application No. PCT/US2017/047875 dated Nov. 21, 2017.

* cited by examiner

BLOWOUT PREVENTER

CROSS REFERENCE TO RELATED APPLICATIONS

Continuation of International Application No. PCT/US2017/047875 filed on Aug. 22, 2017. Priority is claimed from U.S. Provisional Application No. 62/393,511 filed on Sep. 12, 2016. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

BACKGROUND

The present disclosure relates to a blowout preventer. In particular, although not exclusively, the disclosure relates to a blowout preventer for an oil or gas well.

Blowout preventers (BOPS) for oil or gas wells are used to prevent potentially catastrophic events known as a blowouts, where high pressures and/or uncontrolled flow from a subsurface formation can blow tubing (e.g. drill pipe and well casing), tools and fluid out of a wellbore. Blowouts present a serious safety hazard to personnel working near the well, the drilling rig and the environment and can be extremely costly.

BOPs known in the art have rams to close the wellbore when extended into a BOP housing. Such rams are hydraulically pushed into the housing, and thus across the wellbore to close the wellbore. In some cases the rams have hardened steel shears to cut through a drill string or other tool which may be in the wellbore when it is necessary to close the well.

Hydraulically actuated rams require a large amount of hydraulic force to move the rams against the pressure inside the wellbore and to cut through drill strings or other tools.

Such hydraulic force is typically generated away from the blowout preventer, making the blowout preventer susceptible to failure if the hydraulic line conveying the hydraulic force is damaged. Other considerations may include the erosion of cutting and sealing surfaces due to the relatively slow closing action of the rams in the case of a flowing wellbore. Cutting through tool joints, drill collars, large diameter tubulars and off center drill strings under heavy compression may also make more difficult the operation of hydraulically actuated rams.

Once the rams have closed the wellbore and the well has been brought under control, the rams are either retracted or drilled through so that well operations may be resumed.

There are BOPs known in the art that have charge propelled shearing devices. Blowout preventers using a single charge propelled shearing device may have excessive bending moments applied to the wellhead and associated connectors. These excessive bending moments can cause damage to the wellbore which can be expensive to repair. Accurate and clean cutting of the drill string and/or tools in the wellbore can also be less reliable and effective as a result.

Furthermore, significant recoil forces are generated by a charge propelled shearing device when it is activated. In a single charge propelled shearing device system recoil is an unbalanced force which destabilize the BOP and the wellbore.

SUMMARY

In one aspect the present disclosure relates to a blowout preventer comprising a main housing containing a wellbore; a first chamber transverse to the wellbore; a second chamber transverse to the wellbore, diametrically opposed to the first chamber; a first shearing device located in the first chamber; a second shearing device located in the second chamber; and a charge, that when activated propels each shearing device along its respective chamber and across the wellbore into the opposing chamber, such that the first and second shearing devices are adjacent each other.

In some embodiments, the first and second shearing devices are immediately adjacent. In some embodiments, each shearing device has a body section that can effectively block the wellbore and prevent the mass passage of wellbore fluids through the wellbore. Preferably each shearing device has a sealing face of sufficient length and thickness to engage with a wellbore sealing arrangement to prevent passage of wellbore fluids. Preferably, each shearing device has a cutting edge that can cut through tubular sections in the wellbore. Preferably, the cutting edge is arcuate. Preferably, the cutting edge is of a very hard material such as metallic or ceramic alloys.

In some embodiments the blow out preventer comprises at least one retaining device. Typically the at least one retaining device retains each shearing device in a predefined position in the chamber until a sufficient force is exerted on the shearing device. Preferably the retaining device comprises a shear pin arrangement.

In some embodiments the charge comprises a chemical propellant. For example, the chemical propellant may be a deflagrating charge. Alternatively the charge may be an explosive charge. Preferably, the charge is activated by an initiator. For example, the initiator may be a detonator. Preferably, the charge is contained within a casing. Alternatively, the charge may be contained within a portion of the shearing device.

In some embodiments, each shearing device has a piston. Preferably, the piston is adjacent an end of the first or second chamber. Preferably each shearing device has at least one engagement member in an outer edge of the piston, which is adapted to engage with an arresting mechanism. Preferably, the engagement member is an annular ring located at or adjacent an outer edge of the piston. Preferably, the engagement member comprises at least one protrusion. Preferably the arresting mechanism comprises at least one corresponding recess to receive the at least one protrusion of the engagement member.

In some embodiments each of the first and second chambers transversely intersects the wellbore. Preferably the first shearing device is initially located in the first chamber on the first side of the wellbore. Preferably, the second shearing device is initially located in the second chamber on the second side of the wellbore.

In some embodiments each chamber comprises a space in the portion of the respective chamber between the initial location of the shearing device and the wellbore. Preferably the space between the initial location of the shearing device and the wellbore is between zero and a quarter of the length of the diameter of the wellbore. Preferably the space between the initial location of the shearing device and the wellbore is at least as long as a quarter of the diameter of the wellbore. More preferably the space between the initial location of the shearing device and the wellbore is at least as long as half the diameter of the wellbore. More preferably the space between the initial location of the shearing device and the wellbore is longer than the diameter of the wellbore. Preferably the space between the initial location of the shearing device and the wellbore is devoid of liquid. More preferably the space between the initial location of the shearing device and the wellbore is filled with a gas.

In some embodiments the chambers are fluidly sealed from the wellbore. Preferably a seal fluidly seals each chamber from the wellbore. Preferably, the seal is concentric. Preferably the seal in the form of a cylinder that extends in the direction of the wellbore. The seal is typically of a material that is strong enough to withstand the pressure differences between the wellbore and the chambers. The seal typically prevents wellbore fluids from entering the chambers prior to being sheared by the shearing device. Preferably, the second chamber further comprises a sled. Preferably, the sled sits adjacent to and covers the seal.

In some embodiments the blowout preventer comprises an arresting mechanism. Preferably an arresting mechanism is located in each chamber. Preferably, the piston is located in the same chamber as the arresting mechanism. Preferably each piston has a corresponding arresting mechanism.

In some embodiments the arresting mechanism for each piston is located in the same chamber as the respective piston. Preferably the arresting mechanism is located at an end of each chamber adjacent the wellbore. More preferably, the arresting mechanism is located at an opposite end of the chamber to the piston. Preferably each arresting mechanism has at least one engagement slot in an outer edge of the arresting mechanism, which is adapted to engage with a piston. Preferably, the engagement slot is an annular ring located at or adjacent an outer edge of the arresting mechanism. Preferably, the engagement slot is of a complementary shape to the engagement member of the piston.

In some embodiments the arresting mechanism is in the form of an energy absorption mechanism. Preferably, the energy absorption mechanism is adapted to absorb the energy of the shearing device once it has been propelled across the wellbore. Preferably, the energy absorption mechanism is a resiliently deformable material. In some embodiments, the energy absorption mechanism comprises a honeycomb core or simply "cores." In some embodiments, the honeycomb core or "cores" comprise one or more of high density aluminum, stainless steel, titanium and carbon fiber.

In some embodiments the blowout preventer further comprises a wellbore sealing arrangement adapted to seal between the wellbore and the shearing device once the shearing device is located across the wellbore. Preferably the wellbore sealing arrangement has a sealing ring that is adapted to be pressed onto the sealing face of the shearing device. Preferably the sealing ring is located concentrically with the wellbore, having a larger diameter than the wellbore.

In some embodiments the blowout preventer is connected to an existing wellhead. More preferably, the blow out preventer is connected in line between the existing wellhead and one or more standard blowout preventers.

In some embodiments the blowout preventer is capable of operating in up to 18,000 feet depth in salt water, e.g., ocean water. In some embodiments the blowout preventer is capable of withstanding well bore pressures of up to 20,000 PSI. In some embodiments the blowout preventer is capable of withstanding well bore pressures of up to 30,000 PSI. However, it will be appreciated that the blowout preventer may be equally capable of operating at sea level or at elevations above sea level. For example, the blowout preventer may be used as a surface blowout preventer or on a land rig.

In another form the disclosure relates to a drilling rig comprising a blowout preventer as described herein.

Another aspect of the disclosure comprises a deep water drilling vessel comprising a drilling rig and a blowout preventer as described herein.

In another aspect, the disclosure relates to a method of closing a wellbore located within a main housing of a blowout preventer, the method comprising activating two charges to propel two shearing devices located in two opposing chambers in opposite directions along the chambers transverse to the wellbore, such that the shearing device travels across the wellbore to inhibit the flow of wellbore fluids through the wellbore and are adjacent.

In some embodiments, the method includes each shearing device being propelled through a seal fluidly sealing the chambers from the wellbore.

In some embodiments, the method includes a piston located at an end of the shearing device travelling across the chamber into an energy absorption mechanism located in the same chamber.

In some embodiments, when the charge is activated, this results in a rapid expansion of gases which accelerates the shearing devices along the chamber, imparting kinetic energy on the shearing devices. Preferably the shearing device is accelerated along the chamber in the space between the initial location of the shearing device and the wellbore. In some embodiments, the amount of kinetic energy imparted on the shearing device is sufficient to shear any elements which may be present in the wellbore, with or without the assistance of pressure from the charge acting on the shearing device.

In some embodiments, activating the charge includes activating the charge by an initiator in response to a control signal. For example, the chemical propellant may be activated by the initiator in response to a hydraulic signal or an electrical signal. The chemical propellant may also be activated in a fail safe manner. For example, the chemical propellant may be activated by the initiator in response to a loss of a control signal.

In some embodiments, the method includes retaining the shearing device until a sufficient expansion of the charge has occurred. For example, a retaining device in the form of a shear pin arrangement retains the shearing device until a sufficient expansion of the charge (e.g. hot gases) has occurred after activation of the charge, this assists in the rapid acceleration of the shearing device before it travels across the wellbore, or touches the seal.

In some embodiments the method further includes the step of venting the activated charge into the wellbore. For example, once a body section of the shearing device has traveled sufficiently far across the wellbore, remaining hot expanding gases (from the activated charge) can vent downwards into the wellbore, through at least one equalizing port (not shown on figures) in a upper surface of the body section, thus removing the propelling force for continued forward motion of the shearing device along the chambers and equalizing the force across the piston.

In some embodiments the method includes the step of absorbing the kinetic energy of the shearing device. Preferably an energy absorbing material absorbs the kinetic energy of the shearing device. The energy absorbing material is typically adapted to progressively crumple at a predefined rate, as it absorbs energy from the shearing device, eventually bringing the shearing device to rest.

In some embodiments the method includes sealing between the wellbore and a sealing face of the shearing device to inhibit progression of wellbore fluids through the blowout preventer. In some embodiments, the wellbore sealing arrangement is actuated by an external hydraulic force. In some embodiments, the external hydraulic force firmly presses a sealing ring against the sealing face of the shearing device to form a seal against further progression of wellbore fluids through the blowout preventer. It will be understood that if the shearing device is to be pulled clear of the wellbore, the sealing ring is typically retracted from the sealing face of the shearing device.

In some embodiments, the method includes the step of pulling the shearing device clear of the wellbore. This is typically done once well control has been re-established, so that further well control or recovery operations may continue.

DETAILED DESCRIPTION

Figure 1:
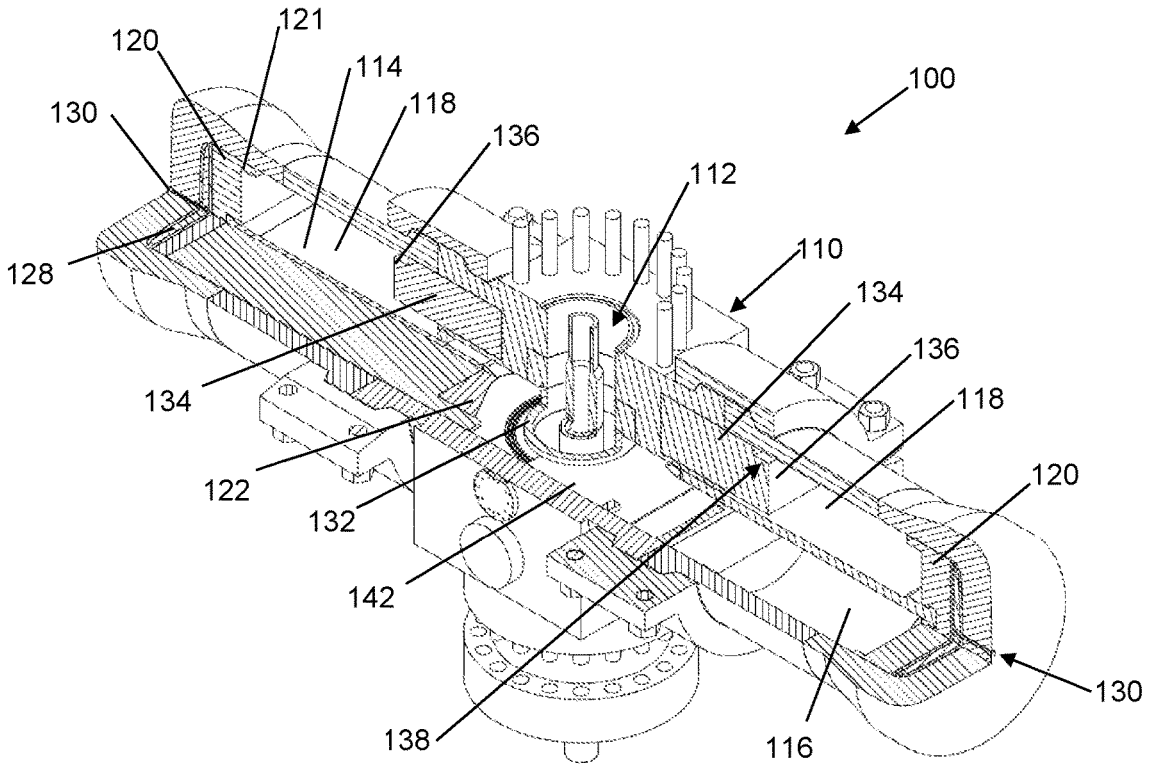
FIG. 1 shows a sectioned view of an example embodiment of a blowout preventer according the present disclosure

FIG. 1 shows a sectioned view of an example embodiment of a blowout preventer 100 according to the present disclosure. The blowout preventer 100 has a main housing 110 having a through bore 112. The example embodiment of the blowout preventer 100 also has a first chamber 114 and a second chamber 116 that are opposing and located transverse to the through bore 112. It will be appreciated that the blowout preventer 100 may be coupled to a wellbore proximate an upper end of the wellbore, for example on a casing flange, or on top of or within other well closure devices associated with a plurality of blowout preventer elements constituting a BOP "stack."

A shearing device 118 having a piston 120 and a cutting edge 122 is located in each chamber 114, 116 on first and second opposing sides 124, 126 of the through bore 112. The piston 120 has an engagement member 121 in the form of an annular ring at an outer edge of the piston 120, which is adapted to engage with an arresting mechanism.

Each chamber 114, 116 comprises a space in the portion of the chamber 114, 116 between the initial location of the shearing device 118 and the through bore 112.

A charge, which in the present example embodiment may be in the form of a chemical propellant 128 is located between the piston 120 of each shearing device 118 and an ignition port 130. The chemical propellant 128 is adapted to propel each shearing device 118 along its respective chamber 114, 116 and across the through bore 112 into the opposing chamber 114, 116, as will be described in greater detail below.

A seal in the form of a cylinder 132 fluidly seals each chamber 114, 116 from the through bore 112.

An arresting mechanism in the form of an energy absorption mechanism 134 is located at the end of each chamber 114, 116 closest to the through bore 112. Each energy absorption mechanism 134 has a front portion 136 having an annular slot 138 at an outer edge of the energy absorption mechanism 134 facing towards the respective piston 120 of the shearing device 118. The annular slot 138 is of a complementary shape to the engagement member 121 of the piston and receives the engagement member 121 once the shearing device 118 has traveled along the length of the chamber 114, 116.

The energy absorption mechanism 134 is configured to absorb the kinetic energy of each shearing device 118, as will be described in greater detail below.

Figure 2:
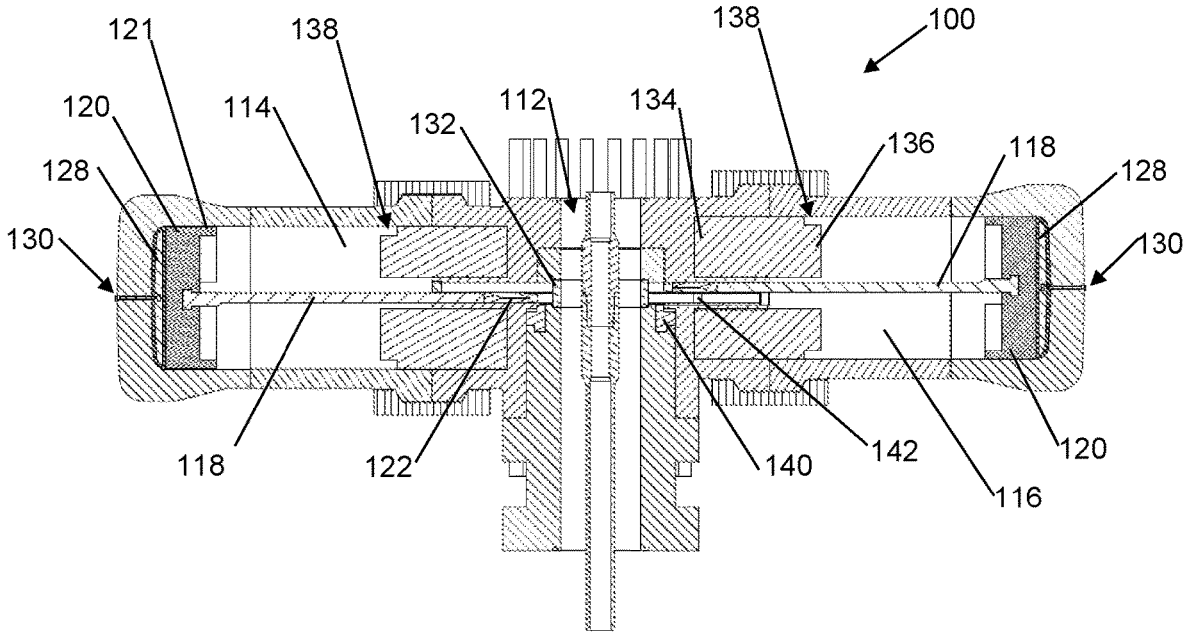
FIG. 2 shows a cross section view of a blowout preventer prior to being activated.

The operation of the blowout preventer 100 will now be explained with reference to FIGS. 2-6. FIG. 2 shows a cross section view of the example embodiment of the blowout preventer 100 prior to being activated. As can be observed in FIG. 2, the charge (e.g., chemical propellant) 128 and shearing device 118 are located in the chambers 114, 116 on opposing sides 124, 126 of the through bore 112.

FIG. 2 also shows the cylinder 132 fluidly sealing the chambers 114, 116 from the through bore 112.

A through bore sealing arrangement 140 is disposed round the through bore 112 which will be explained in more detail below. The energy absorption mechanism 134 is located within each chamber 114, 116 on each side 124, 126 of the through bore 112. As can be observed, each energy absorption mechanism 134 is located in the same chamber 114, 116 as the shearing device 118 that the energy absorption mechanism 134 will arrest.

Figure 3:
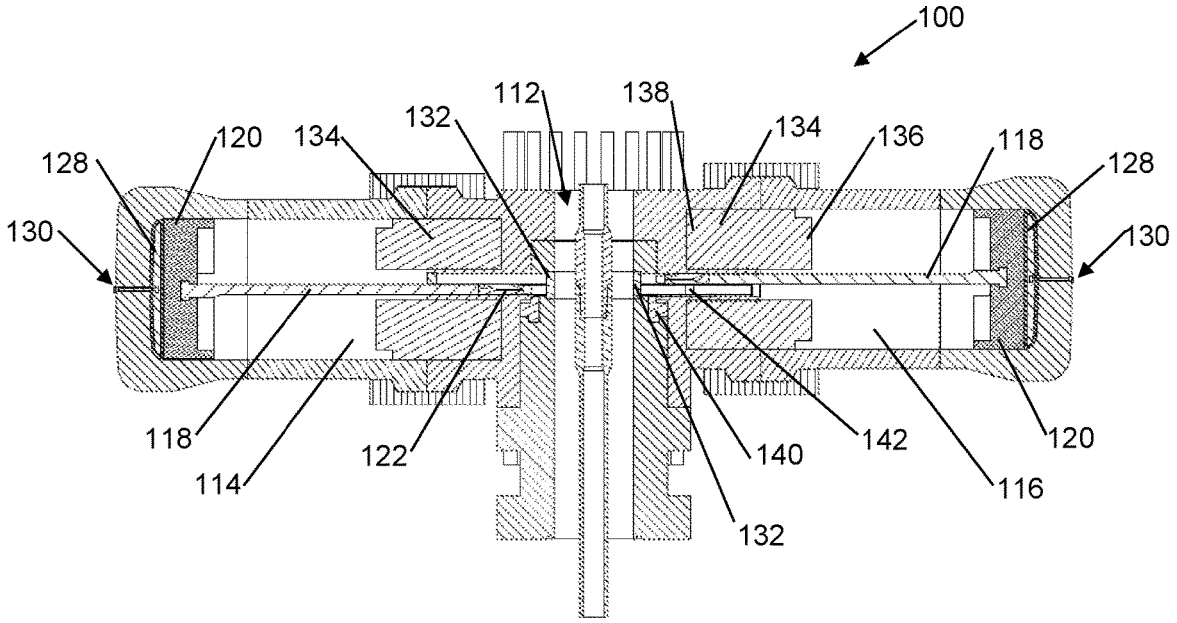
FIG. 3 shows a cross section view of a blowout preventer that has been activated.

FIG. 3 shows a cross section view of the example embodiment of the blowout preventer 100 where the chemical propellant 128 has been activated by the ignition port 120. The shearing devices 118 are held in place by a shear pin (not shown) until a sufficient expansion of hot gases has occurred after activation of the chemical propellant 128.

Once a sufficient expansion of hot gases has occurred after activation of the chemical propellant 128 to cause pressure to shear the shear pin (not shown), the shearing devices 118 accelerate along the chambers 114, 116 towards the cylinder 132 and through bore 112.

As the shearing devices 118 accelerate along the chambers 114, 116 and begin to shear the cylinder 120, the shearing devices 118 will also shear any wellbore tubulars, tools, drill strings or the like which are present in the through bore 112. The shearing devices 118 pass one another in the through bore 112.

Figure 4:
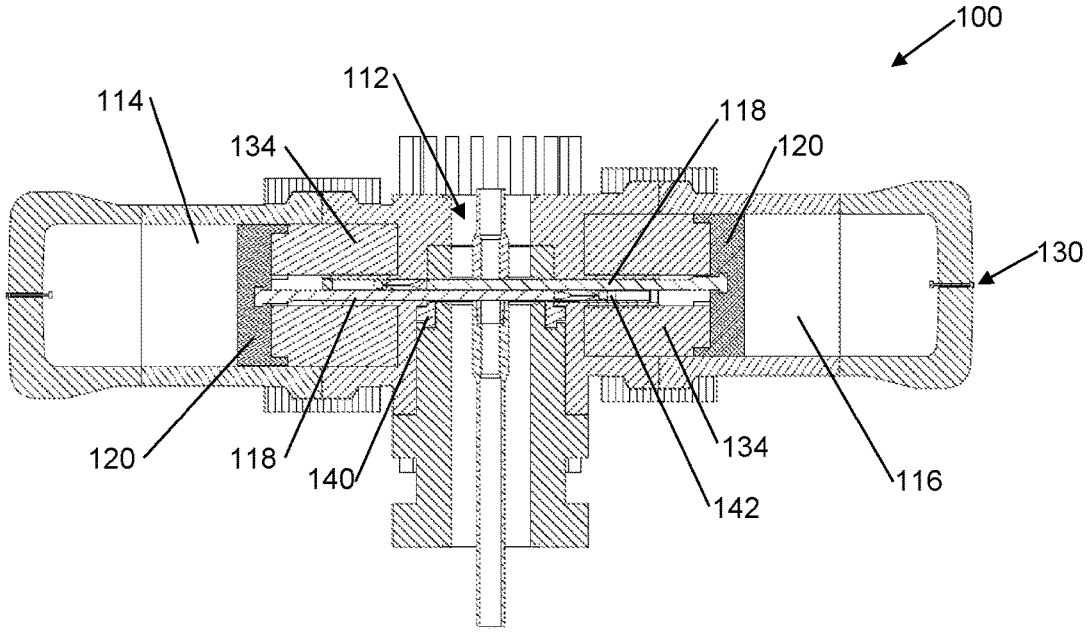
FIG. 4 shows a cross section view of a blowout preventer in a minimum arrest state with the shearing device having sheared the wellbore.

FIG. 4 shows a cross section view of the blowout preventer 100 where the first shearing device 118 has connected with the sled 142 and the piston 120 has engaged with the energy absorption mechanism 134 in a minimum arrest state. The sled 142 covers and protects the through bore sealing arrangement 140. As shown, the shearing devices 118 are immediately adjacent to one another and sit in close contact with a small clearance between shearing devices 118. In operation, the shearing devices 118 will likely be in intimate contact once pressure is applied from the below from the wellbore.

The pistons 120 of the shearing devices 118 have engaged with and have started to be arrested by the energy absorption mechanism 134 without significantly deforming the energy absorption mechanism 134.

Figure 5:
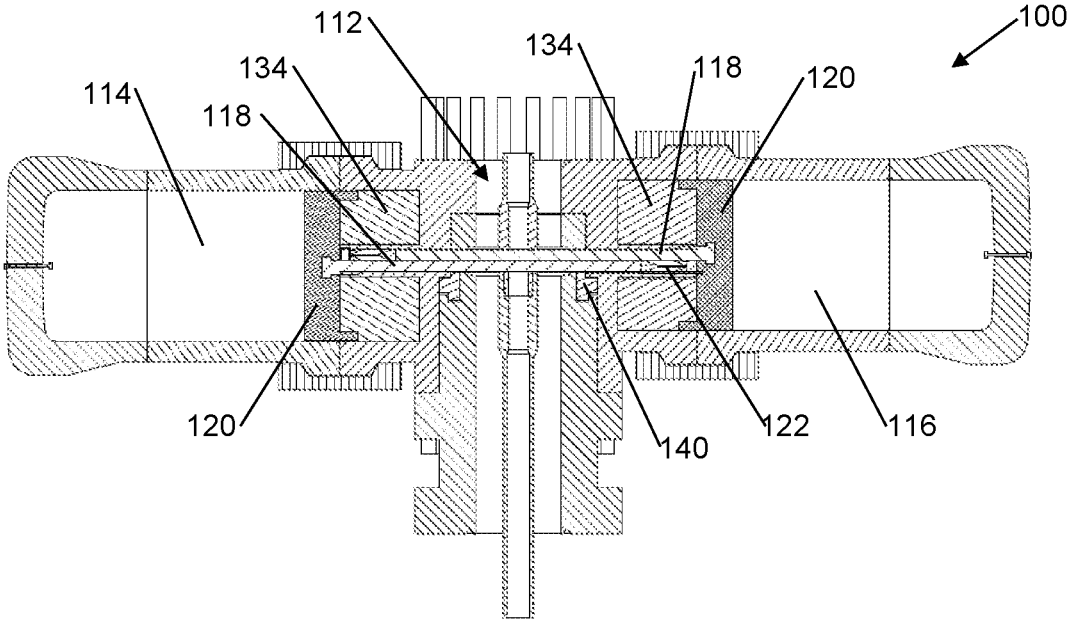
FIG. 5 shows a cross section view of a blowout preventer in a maximum arrest state with the shearing device having sheared the wellbore.

FIG. 5 shows a cross section view of the blowout preventer 100 in a maximum arrest state. The shearing devices 118 have connected with the sled 142 of the energy absorption mechanism 134. In the figure shown, the shearing devices 118 have not had to shear any heavy materials contained in the through bore 112 and therefore require maximum arresting. As a result, the pistons 120 have engaged and deformed the energy absorption mechanism 134 to arrest the acceleration of the shearing devices 118.

The energy absorption mechanism 134 will retain the shearing devices 118 in such a position that a sealing face (not shown) of each shearing device 118 is sufficiently aligned with the through bore sealing arrangement 140. Once the shearing device 118 is sufficiently aligned with the through bore sealing arrangement 140, the sealing arrangement 140 will firmly press a sealing ring (not shown) against the sealing face (not shown) of the shearing device 118, to stop the flow of wellbore fluids through the through bore 112, thereby securing the well. Once the well is secured, well control operations (for example choke and kill operations) can commence. In some embodiments, the energy absorption mechanism 134 may comprise a honeycomb or cores. In some embodiments, the honeycomb or cores comprise one or more of high density aluminum, stainless steel, titanium and carbon fiber.

Figure 6:
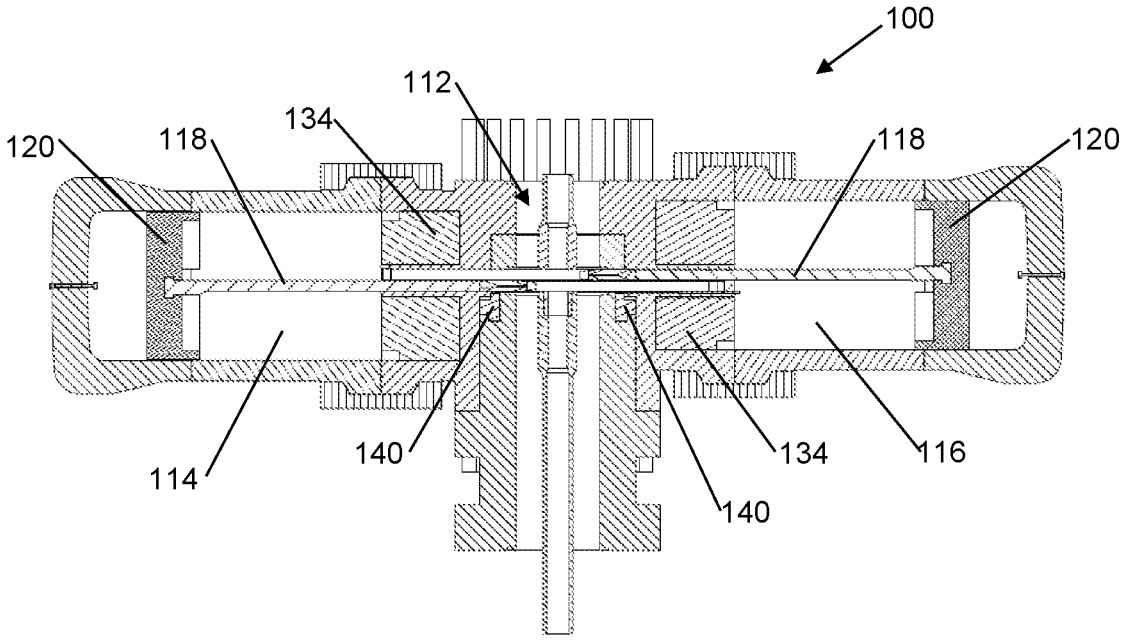
FIG. 6 shows a cross section view of a blowout preventer with the shearing device being pulled clear of the wellbore.

Once well control has been re-established, the blowout preventer 100 can be de-activated as seen in FIG. 6. As shown in FIG. 6, the sealing arrangement 144 retracts the sealing ring (not shown) from the sealing face (not shown) of the shearing devices 118 and the shearing devices 118 are pulled clear of the through bore 112.

Figure 7:
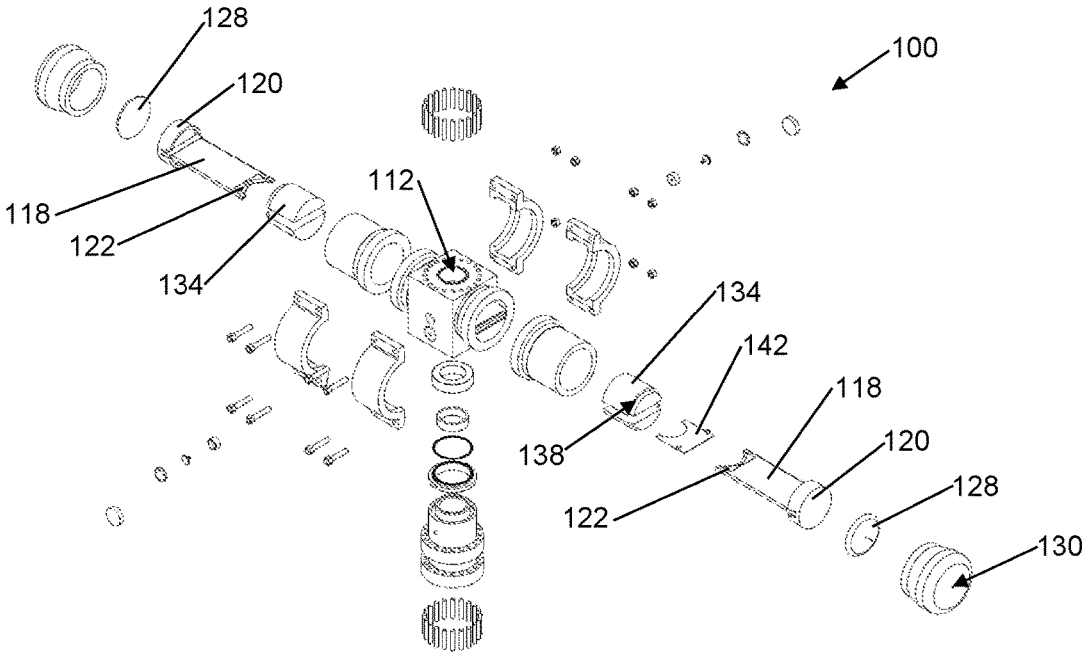
FIG. 7 shows an exploded view of the blowout preventer.

FIG. 7 shows an exploded view of the example embodiment of the blowout preventer 100.

Figure 8:
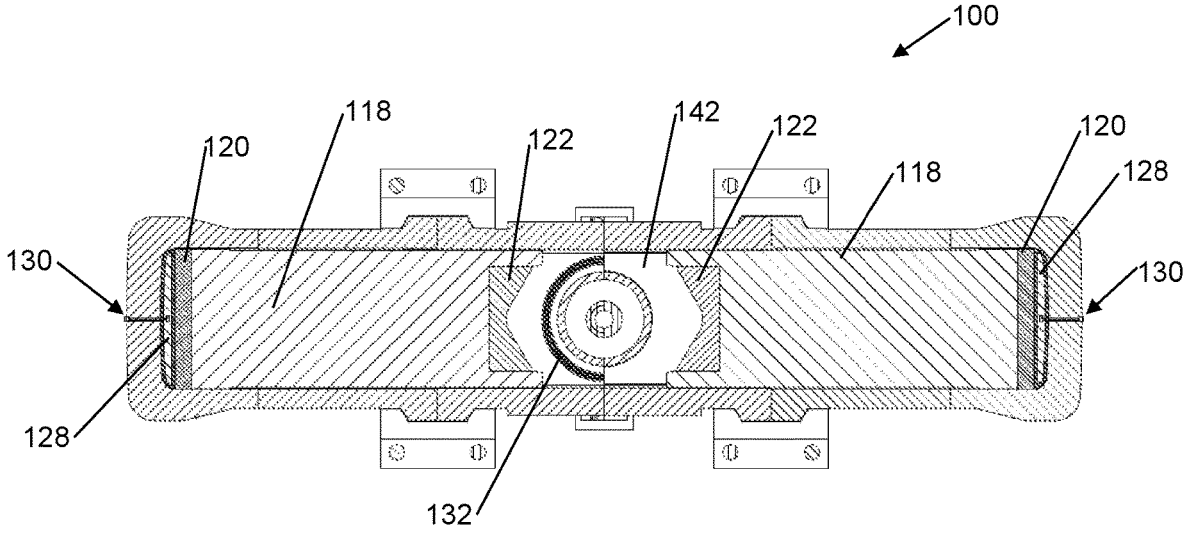
FIG. 8 shows a top down view of the blowout preventer prior to being activated.

FIG. 8 shows a top down view of the blowout preventer 100 prior to being activated. FIG. 8 more clearly illustrates the arcuate shape of the cutting edge 122 of the shearing device 118.

A possible advantage of a blowout preventer made according to the present disclosure is that the blowout preventer can be actuated without having to produce hydraulic forces to hydraulically push rams across the through bore to close off the through bore. Instead, the energy required to close the through bore is contained in the charge in the blowout preventer where it is required.

A possible advantage of holding the shearing device 118 in place by a shear pin is that this assists in the rapid acceleration of the shearing device 118 along the chambers 114, 116 once sufficient force has been generated by the expanding gases of the chemical propellant 128.

A possible advantage of having the cylinder 130 fluidly sealing the chambers 114, 116 from the through bore 112 is that the shearing devices 118 can accelerate along the chambers 114, 116 unhindered by wellbore fluids or other liquids until the shearing devices 118 starts to shear the cylinder 130.

A possible advantage of having a space between the initial location of the shearing device 118 and the through bore 112 is that the shearing device 118 reaches sufficient velocity to shear any device disposed within the through bore 112.

A possible advantage of using an energy absorption mechanism 134 is that excess kinetic energy of the shearing devices 118 is not directly transferred into a structural portion of the blowout preventer 100.

A possible advantage of pulling the shearing devices 118 clear of the through bore 112 is that the shearing devices 118 do not have to be drilled through for wellbore operations to recommence.

A possible advantage of a blowout preventer according to the present disclosure is that the use of two adjacent shearing devices may provide two opposing forces that minimize, and effectively cancel recoil.

A further possible advantage is that the bending moments imparted on the wellhead are reduced by the use of a second shearing device acting from an opposite side to the first shearing device. In effect, the two shearing devices 'scissor' the through bore Another possible advantage is that the sled 142 covers and protects the through bore sealing arrangement 140 from debris and damage during the shearing phase and then opens up during the arresting phase to ensure a seal can be actuated.

Another possible advantage is that the larger circumference of the piston and energy absorption mechanism provide a more effective arresting system.

The foregoing embodiments are illustrative only of the principles of a blowout preventer according to the present disclosure, and various modifications and changes will readily occur to those skilled in the art. The blowout preventer as described herein is capable of being made and used in various ways and in other embodiments. For example, individual features from one embodiment may be combined with another embodiment. It is also to be understood that the terminology employed herein is for the purpose of description and should not be regarded as limiting. Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A blowout preventer comprising:

a main housing containing a through bore;

a first chamber transverse to the through bore;

a second chamber transverse to the through bore, diametrically opposed to the first chamber;

a first shearing device located in the first chamber, the first shearing device having an elongated planar body linked to a first piston;

a second shearing device located in the second chamber, the second shearing device having an elongated planar body linked to a second piston;

the first chamber and second chamber each comprising an arresting mechanism having an energy absorption mechanism configured with a resiliently deformable material; and a first charge and a second charge, each charge configured for activation to propel each respective shearing device along its respective chamber and across the through bore into the opposing chamber, such that the planar bodies of the first and second shearing devices are adjacent each other to inhibit fluid flow through the through bore.

2. The blowout preventer of claim 1 wherein the first and second shearing devices are immediately adjacent each other.

3. The blowout preventer of claim 1 wherein each shearing device has a housing arranged to block the through bore and substantially prevent passage of wellbore fluids through the through bore.

4. The blowout preventer of claim 1 wherein each shearing device has a cutting edge that can cut through tubular sections in the through bore.

5. The blowout preventer of claim 4 wherein the cutting edge is arcuate.

6. The blowout preventer of claim 1 further comprising at least one retaining device to retain each shearing device in a predetermined position in the respective chamber until a sufficient force is exerted on the shearing device caused by actuation of the charge.

7. The blowout preventer of claim 6 wherein the retaining device comprises a shear pin.

8. The blowout preventer of claim 1 wherein each charge comprises a chemical propellant.

9. The blowout preventer of claim 8 wherein the chemical propellant comprises at least one of a deflagrating charge and an explosive charge.

10. The blowout preventer of claim 8 wherein the chemical propellant comprises an initiator.

11. The blowout preventer of claim 10 wherein the initiator comprises a detonator.

12. The blowout preventer of claim 1 wherein each shearing device is configured with the piston at one end thereof and a cutting edge at an opposing end thereof.

13. The blowout preventer of claim 1 wherein each piston is disposed adjacent an end of the chamber.

14. The blowout preventer of claim 1 wherein each shearing device has at least one engagement member in an outer edge of the piston, the piston adapted to engage with the respective arresting mechanism.

15. The blowout preventer of claim 14 wherein, the engagement member comprises an annular ring located at or adjacent an outer edge of the piston.

16. The blowout preventer of claim 14 wherein the arresting mechanism comprises at least one corresponding recess to receive at least one protrusion of the engagement member.

17. The blowout preventer of claim 1 wherein the first shearing device is initially located in the first chamber on a first side of the through bore and the second shearing device is initially located in the second chamber on a second side of the through bore diametrically opposed and in the same plane with the first side.

18. The blowout preventer of claim 1 wherein each chamber comprises a space in a portion of the respective chamber between an initial location of the respective shearing device and the through bore wherein the space between the initial location of the respective shearing device and the through bore is between zero and a quarter of the length of the diameter of the through bore.

19. The blowout preventer of claim 1 wherein each chamber comprises a space in a portion of the respective chamber between an initial location of the respective shearing device and the through bore, wherein the space between the initial location of the respective shearing device and the through bore is longer than the diameter of the through bore.

20. The blowout preventer of claim 1 wherein the chambers are fluidly sealed from the through bore.

21. The blowout preventer of claim 1 wherein the second chamber further comprises a sled, the sled disposed adjacent to and covering a seal.

22. The blowout preventer of claim 1 wherein each arresting mechanism is located at an end of each chamber adjacent the through bore.

23. The blowout preventer of claim 1 wherein each energy absorption mechanism comprises a honeycomb core.

24. The blowout preventer of claim 23 wherein the honeycomb core comprises one of high density aluminum, stainless steel, titanium and carbon fiber.

25. The blowout preventer of claim 1 further comprising a through bore sealing arrangement adapted to seal between the through bore and each shearing device when each shearing device is located across the through bore.

26. The blowout preventer of claim 25 wherein each through bore sealing arrangement comprises a sealing ring that is adapted to be pressed onto a sealing face of each shearing device.

27. The blowout preventer of claim 26 wherein each sealing ring is located concentrically with the through bore and has a larger diameter than the through bore.

28. The blowout preventer of claim 1 wherein each of the first and second shearing devices is linked to the respective piston by a coupling junction.

29. The blowout preventer of claim 28 wherein the coupling junction on each of the first and second shearing devices comprises a T-shaped end on each shearing device and a corresponding T-shaped opening in each piston.

30. A method of closing a through bore located within a main housing of a blowout preventer, the method comprising:

activating two charges, each charge to propel a respective first and second shearing device, the first and second shearing devices each having an elongated planar body respectively linked to a piston located in a respective one of two opposing chambers disposed in opposite directions along the chambers transverse to the through bore, such that the first and second shearing devices each travel across the through bore with the planar bodies of the devices adjacent each other to inhibit the flow of wellbore fluids through the through bore, wherein each of the two opposing chambers comprises an arresting mechanism having an energy absorption mechanism configured with a resiliently deformable material.

31. A blowout preventer comprising:

a housing containing a through bore;

a first chamber transverse to the through bore;

a second chamber transverse to the through bore, diametrically opposed to the first chamber:

a first shearing device located in the first chamber and linked to a first piston;

a second shearing device located in the second chamber and linked to a second piston;

a first charge and a second charge, each charge configured for activation to propel each respective shearing device along its respective chamber and across the through bore; and an arresting mechanism located in each of the chambers configured to bring the shearing device in the respective chamber to rest, the arresting mechanism having an energy absorption mechanism configured with a resiliently deformable material.

32. The blowout preventer of claim 31 wherein the first and second shearing devices are respectively linked to the first and second pistons via a coupling junction comprising a T-shaped end on each shearing device and a corresponding T-shaped opening in each piston.

33. The blowout preventer of claim 31 wherein each arresting mechanism is disposed at an end of the chamber opposed to the charge.

* * * * *